US012458188B2

(12) United States Patent
Cho et al.

(10) Patent No.: US 12,458,188 B2
(45) Date of Patent: Nov. 4, 2025

(54) VACUUM CLEANER

(71) Applicant: SAMSUNG ELECTRONICS CO., LTD., Suwon-si (KR)

(72) Inventors: Youngjun Cho, Suwon-si (KR); Ohkyu Kwon, Suwon-si (KR); Jiwook Chung, Suwon-si (KR); Dongjin Cho, Suwon-si (KR); Seongtae Chu, Suwon-si (KR); Hyeonwoo Tak, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 393 days.

(21) Appl. No.: 18/089,052

(22) Filed: Dec. 27, 2022

(65) Prior Publication Data

US 2023/0136405 A1 May 4, 2023

Related U.S. Application Data

(63) Continuation of application No. PCT/KR2021/006412, filed on May 24, 2021.

(30) Foreign Application Priority Data

Jul. 17, 2020 (KR) ..... 10-2020-0088986

(51) Int. Cl.
*A47L 9/14* (2006.01)
*A47L 5/28* (2006.01)
(Continued)

(52) U.S. Cl.
CPC ..... *A47L 9/149* (2013.01); *A47L 5/28* (2013.01); *A47L 9/1409* (2013.01);
(Continued)

(58) Field of Classification Search
CPC ..... A47L 9/149; A47L 5/28; A47L 9/1409; A47L 9/1463; A47L 9/1683; A47L 9/1691; A47L 9/2884
See application file for complete search history.

(56) References Cited

U.S. PATENT DOCUMENTS 5,617,610 A * 4/1997 Dearaujo ..... A47L 5/28 15/328
6,513,191 B1 * 2/2003 Kim ..... A47L 9/244 285/7
(Continued)

FOREIGN PATENT DOCUMENTS

CN 1951295 A1 4/2007
JP 3529131 5/2004
(Continued)

OTHER PUBLICATIONS

International Search Report dated Sep. 14, 2021, issued in PCT Application No. PCT/KR2021/006412.
(Continued)

*Primary Examiner* — Marc Carlson
(74) *Attorney, Agent, or Firm* — STAAS & HALSEY LLP

(57) ABSTRACT

A vacuum cleaner including a housing having a dust collection chamber; a main body that is movable against the housing between a first position and a second position; a rubbish removal member in the dust collection chamber; and an opening or closing device. When the main body is moved against the housing from the first position to the second position, the opening or closing device opens the dust collection chamber, and the rubbish removal member moves toward an open end of the dust collecting chamber to allow rubbish removed by the rubbish removal member to be discharged out of the dust collection chamber. When the main body is moved against the housing from the second
(Continued)

position to the first position, the rubbish removal member moves toward an inside of the dust collection chamber, and the opening or closing device closes the dust collection chamber.

15 Claims, 10 Drawing Sheets

(51) Int. Cl.
*A47L 9/16* (2006.01)
*A47L 9/28* (2006.01)

(52) U.S. Cl.
CPC ..... *A47L 9/1463* (2013.01); *A47L 9/1683* (2013.01); *A47L 9/1691* (2013.01); *A47L 9/2884* (2013.01)

(56) References Cited

U.S. PATENT DOCUMENTS

| | | | | |
|---|---|---|---|---|
| 10,555,652 | B2 * | 2/2020 | Han | A47L 9/1608 |
| 11,064,855 | B2 * | 7/2021 | Hwang | A47L 9/1683 |
| 11,191,406 | B2 * | 12/2021 | Cho | A47L 5/28 |
| 11,647,882 | B2 * | 5/2023 | Cho | A47L 9/1633 15/329 |
| 2001/0025395 | A1 * | 10/2001 | Matsumoto | A47L 9/1683 55/447 |
| 2004/0187253 | A1 * | 9/2004 | Jin | A47L 9/20 15/352 |
| 2016/0174789 | A1 | 6/2016 | Han et al. | |
| 2019/0150686 | A1 | 5/2019 | Horne et al. | |
| 2019/0167058 | A1 * | 6/2019 | Cho | A47L 9/104 |
| 2020/0281429 | A1 * | 9/2020 | Cho | A47L 9/149 |

FOREIGN PATENT DOCUMENTS

| | | |
|---|---|---|
| JP | 6047694 | 12/2016 |
| KR | 20-0185773 | 6/2000 |
| KR | 10-0381220 | 4/2003 |
| KR | 2003-0052837 | 6/2003 |
| KR | 10-1420406 | 7/2014 |
| KR | 10-2017-0046346 | 5/2017 |
| KR | 10-2017-0061274 | 6/2017 |
| KR | 10-2018-0023790 | 3/2018 |
| KR | 10-1905059 | 11/2018 |
| KR | 10-2019-0066239 | 6/2019 |
| KR | 10-2093931 | 3/2020 |
| KR | 10-2020-0107756 | 9/2020 |
| WO | WO 2019/233554 A1 | 12/2019 |

OTHER PUBLICATIONS

Written Opinion dated Sep. 14, 2021 issued in PCT Application No. PCT/KR2021/0064120.

* cited by examiner

VACUUM CLEANER

CROSS-REFERENCE TO RELATED APPLICATIONS

This application is a continuation of International Application PCT/KR2021/006412 filed May 24, 2021, and claims foreign priority to Korean application 10-2020-0088986 filed Jul. 17, 2020, the disclosures of which are incorporated herein by reference in their entireties.

BACKGROUND

1. Field

The disclosure relates to a vacuum cleaner, and more particularly, to a vacuum cleaner having an enhanced structure.

2. Description of Related Art

Cleaners are machines for removing rubbish to clean the room, and vacuum cleaners are often used in many households. The vacuum cleaner cleans the room by sucking up air with suction force of a fan motor unit and then separating rubbish in the air through a device such as a filter. The vacuum cleaners may have canister types and upright types, and robot vacuum cleaners that perform cleaning by sucking up rubbish such as dust from a floor to be cleaned while running around on its own in a cleaning area without user's manipulation are becoming popular these days.

The vacuum cleaner includes a dust collection device inside to filter off the rubbish contained in the air sucked in with a filtering device. For the filtering device to filter off the rubbish in the dust collection device, there is a porous filtering device having a method of forcedly filtering the rubbish while the air passes a porous filter, and a cyclone type dust collection device that filters off the rubbish during a cyclone movement of the air.

The vacuum cleaner is unsanitary and inconvenient to use because rubbish such as human or animal hair gets tangled with the dust collection device, making the user have to untangle the rubbish in person from the dust collection device.

SUMMARY

According to an embodiment of the disclosure, a vacuum cleaner includes a housing having a dust collection chamber inside the housing; a main body that is movable against the housing between a first position and a second position; a guide device to guide movement of the main body against the housing; a rubbish removal member in the dust collection chamber; and an opening or closing device to open or close the dust collection chamber, wherein the main body, the guide device, the rubbish removal member, and the opening or closing device are configured so that, (a) when the main body is moved against the housing from the first position to the second position, the opening or closing device opens the dust collection chamber, and the rubbish removal member moves toward an open end of the dust collecting chamber to allow rubbish removed by the rubbish removal member to be discharged out of the dust collection chamber, and (b) when the main body is moved against the housing from the second position to the first position, the rubbish removal member moves away from the open end of the dust collection chamber toward an inside of the dust collection chamber, and the opening or closing device closes the dust collection chamber.

According to an embodiment of the disclosure, the guide device may include a roller protruding from a surface of the guide device facing the main body toward the main body.

According to an embodiment of the disclosure, the roller may have a rotation axis perpendicular to a moving direction of the main body.

According to an embodiment of the disclosure, the roller may be arranged to roll on an outer surface of the main body.

According to an embodiment of the disclosure, the guide device may include a body rotationally supporting the roller.

According to an embodiment of the disclosure, the guide device may include a plurality of rollers equidistantly spaced apart from each other along an outer circumference of the main body.

According to an embodiment of the disclosure, the guide device may further include a stopper to limit movement of the main body to an opposite direction from a direction toward the first position in response to the main body being in the second position.

According to an embodiment of the disclosure, the stopper may include a buffer material.

According to an embodiment of the disclosure, the main body may include a battery installation portion in which a battery is mounted, and in response to the main body being in the second position, the stopper may be arranged to support the battery installation portion.

According to an embodiment of the disclosure, the battery installation portion may be in the housing.

According to an embodiment of the disclosure, the guide device may be provided in the singular, or in the plural at certain intervals in a moving direction of the main body.

According to an embodiment of the disclosure, the housing may include a guide installation portion formed on an inner surface of the housing to install and fix the guide device.

According to an embodiment of the disclosure, the dust collection chamber may be a first dust collection chamber, the main body may include a rubbish separation device to remove rubbish from air having passed the first dust collection chamber, and a second dust collection chamber may be in the housing to collect the rubbish separated from the rubbish separation device.

According to an embodiment of the disclosure, the rubbish removal member may be a first rubbish removal member, and the vacuum cleaner may include a second rubbish removal member arranged to slide on the second dust collection chamber and the first dust collection chamber to discharge rubbish from the second dust collection chamber in response to the main body moving from the first position to the second position.

According to an embodiment of the disclosure, a vacuum cleaner may include a housing equipped with a dust collection chamber inside, a main body arranged to be movable against the housing between a first position to close the dust collection chamber and a second position to open the dust collection chamber, and including an opening or closing device arranged to open or close the dust collection chamber, and a guide device arranged to guide movement of the main body against the housing, wherein the guide device includes a roller arranged to roll on an outer surface of the main body, and a body for rotationally supporting the roller.

According to an embodiment of the disclosure, the roller may be arranged to have a rotation axis perpendicular to a moving direction of the main body.

According to an embodiment of the disclosure, the guide device may include a plurality of rollers arranged to be equidistantly spaced apart from each other along an outer circumference of the main body.

According to an embodiment of the disclosure, the guide device may further include a stopper arranged to limit movement of the main body to an opposite direction from a direction toward the first position in response to the main body being in the second position.

According to an embodiment of the disclosure, the stopper may be formed to include a buffer material.

According to an embodiment of the disclosure, the guide device may be provided in the plural at certain intervals in a moving direction of the main body.

Additional aspects will be set forth in part in the description which follows and, in part, will be apparent from the description, or may be learned by practice of the presented embodiments.

BRIEF DESCRIPTION OF THE DRAWINGS

Above and other aspects, features, and advantages of certain embodiments of the present disclosure will be more apparent from the following description taken in conjunction with the accompanying drawings, in which.

DETAILED DESCRIPTION

Figure 1:
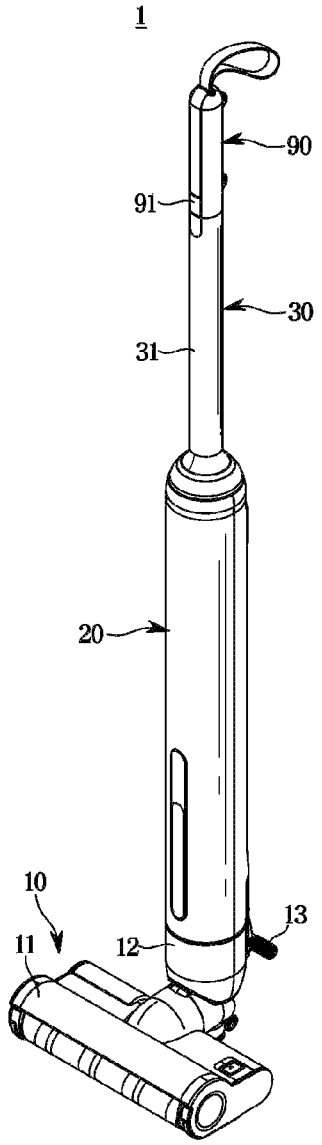
FIG. 1 is a perspective view of a vacuum cleaner, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Various embodiments of the disclosure provide provides a vacuum cleaner capable of easily discharging rubbish collected in a dust collection chamber.

Moreover, various embodiments of the disclosure also provide a vacuum cleaner capable of easily moving a main body against a housing.

According to various embodiments of the disclosure, a vacuum cleaner may easily discharge rubbish collected in a dust collection chamber by having a body arranged to slide to open or close a dust collection chamber.

Further, according to various embodiments of the disclosure, a vacuum cleaner may include a guide device arranged between a housing and a main body to facilitate movement of the main body against the housing.

Reference will now be made in detail to embodiments of the disclosure, which are illustrated in the accompanying drawings. Where a suction head 10 is arranged in FIG. 1 may be defined as front and where a handle 90 is arranged may be defined as back. In other words, it may be defined that air is brought in at the front of a vacuum cleaner 1 and discharged through the back. Shapes and positions of respective components are not, however, limited by the terms defined as described above.

Figure 2:
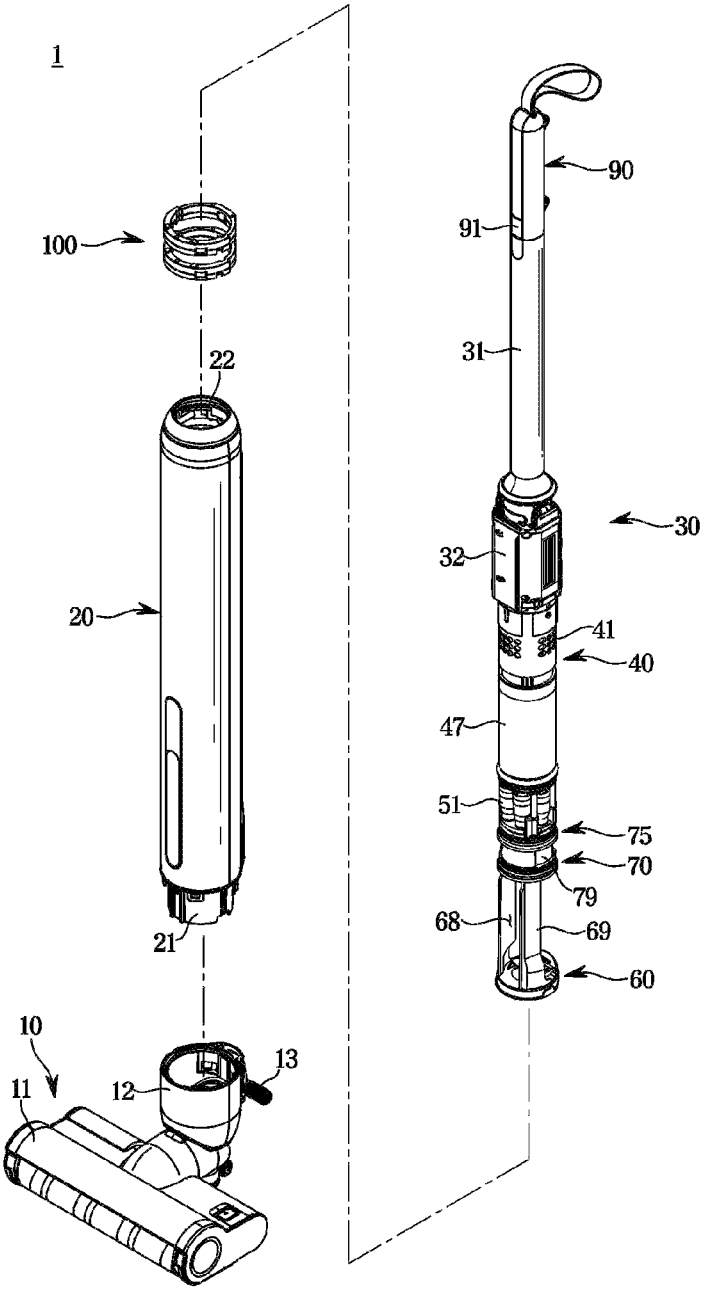
FIG. 2 is an exploded view of the vacuum cleaner shown in FIG. 1, according to an embodiment of the disclosure.
Figure 3:
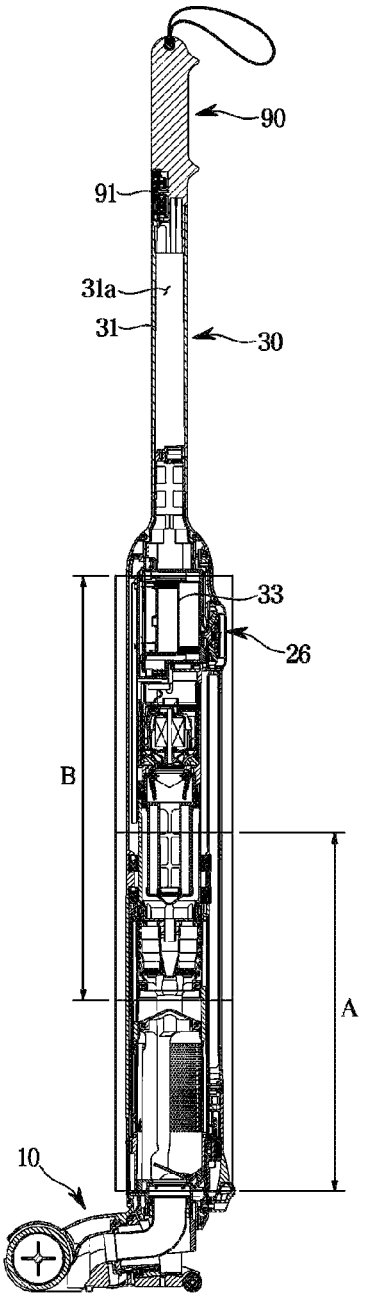
FIG. 3 is a cross-sectional view of the vacuum cleaner shown in FIG. 1, according to an embodiment of the disclosure.
Figure 4:
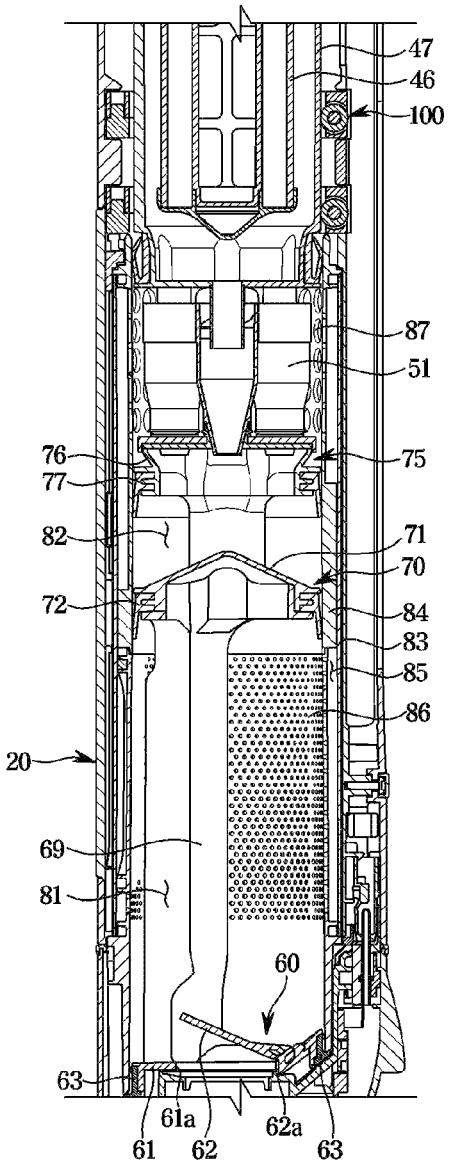
FIG. 4 is an enlarged view of portion A marked in FIG. 3, according to an embodiment of the disclosure.
Figure 5:
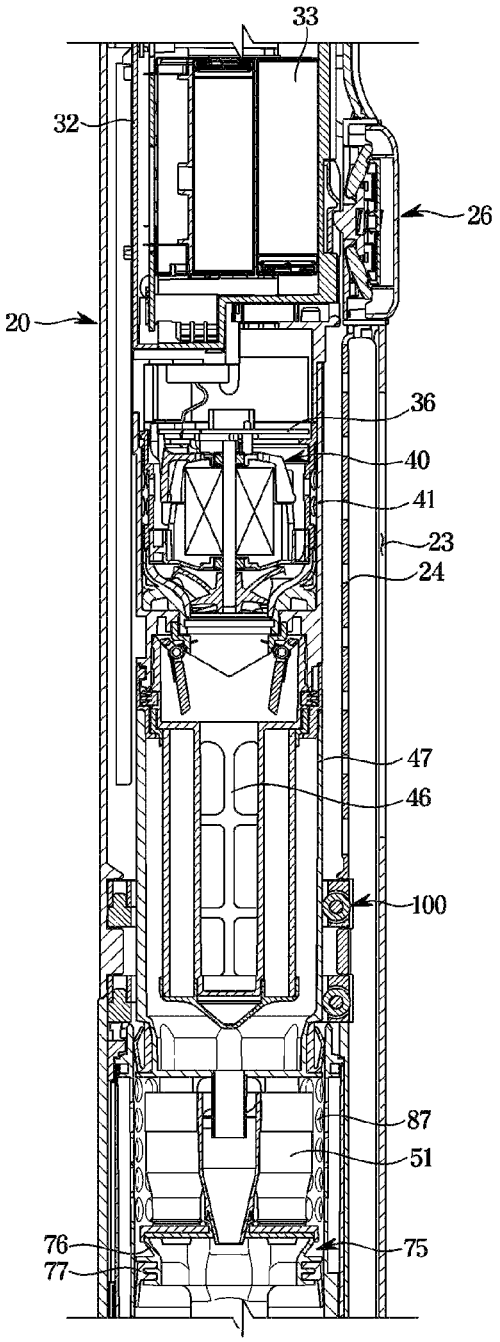
FIG. 5 is an enlarged view of portion B marked in FIG. 3, according to an embodiment of the disclosure.
Figure 6:
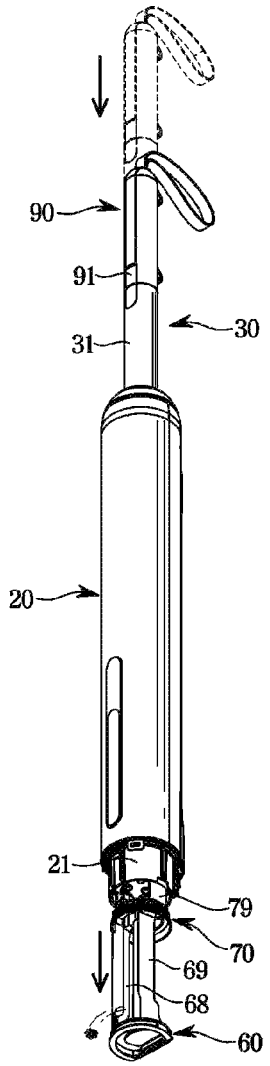
FIG. 6 illustrates emptying dust out of the vacuum cleaner shown in FIG. 1, according to an embodiment of the disclosure.

FIG. 1 is a perspective view of a vacuum cleaner, according to an embodiment of the disclosure. FIG. 2 is an exploded view of the vacuum cleaner shown in FIG. 1. FIG. 3 is a cross-sectional view of the vacuum cleaner shown in FIG. 1. FIG. 4 is an enlarged view of portion A marked in FIG. 3. FIG. 5 is an enlarged view of portion B marked in FIG. 3. FIG. 6 illustrates emptying dust out of the vacuum cleaner shown in FIG. 1.

Referring to FIGS. 1 and 2, the vacuum cleaner 1 may include the suction head 10 provided to suck up rubbish such as hair on a floor to be cleaned with suction force of air, a housing 20 connected to the suction head 10, and a main body 30 arranged to be movable to the interior of the housing 20.

The suction head 10 is provided to suck up rubbish such as dust present on the floor to be cleaned while moving around on the floor to be cleaned. The suction head 10 may include a head assembly 11, a neck part 12, and a head switch 13.

An air flow path may be formed in the head assembly 11. The air flow path formed in the head assembly 11 may be linked to the housing 20 through the neck part 12. Outside air and rubbish brought in through the head assembly 11 may be moved into the housing 20 through the neck part 12.

The neck part 12 may be connected to the lower end of the housing 20. The neck part 12 may be rotationally coupled to the head assembly 11. As the neck part 12 is rotated against the head assembly 11, the head assembly 11 may be rotated against the housing 20 connected to the neck part 12. Accordingly, the vacuum cleaner 1 may be operated with an improved degree of freedom.

The head switch 13 is provided to fix or unfix a coupled state between the suction head 10 and the housing 20. The user may manipulate the head switch 13 to detach the housing 20 from the suction head 10. With the head switch 13 arranged at the suction head 10, the user may detach the housing 20 from the suction head 10 by manipulating the head switch 13 with his/her foot without bending his/her back.

The housing 20 may form a portion of the exterior of the vacuum cleaner 1. An end portion 21 of the housing 20 may be mounted in the suction head 10. The housing 20 may include a cavity 22 formed for the main body 30 to be movably inserted therein Referring to FIGS. 3 and 5, a button device 26 formed to fix the position of the main body 30 against the housing 20 may be provided at the housing 20. The user may move the main body 30 against the housing 20 by manipulating the button device 26 to unfix the main body 30 from the housing 20.

The main body 30 may be slidably coupled to the housing 20. The main body 30 may be arranged to be movable between a first position to close the dust collection chambers 81 and 82 and a second position to open the dust collection chambers 81 and 82.

A guide device 100 may be arranged between the housing 20 and the main body 30. The guide device 100 may guide and support the movement of the main body 30 against the housing 20. The guide device 100 will be described later.

The main body 30 may include an extension 31 that defines a portion of the exterior of the vacuum cleaner 1. A room 31*a* for receiving an electric wire extending toward an operation switch 91 may be formed in the extension 31.

The handle 90 may be arranged at a rear end of the extension 31. The handle 90 may be arranged at the other end of the main body 30 opposite from an end at which an opening or closing device 60 is arranged. When using the vacuum cleaner 1, the user may hold the handle 90 to push or pull the suction head 10.

The operation switch 91 may be arranged on the handle 90 to control operation of the vacuum cleaner. The operation switch 91 is provided to receive a command to start the vacuum cleaner 1 from the user. The operation switch 91 may be placed adjacent to the handle 90 for the user to manipulate the operation switch 91 while moving the vacuum cleaner 1 for cleaning.

The main body 30 may include a battery installation portion 32. A battery 33 may be mounted in the battery installation portion 32. One, two or more batteries 33 may be provided. The battery installation portion 32 may be located in the housing 20.

The main body 30 may be equipped with a fan motor unit 40 configured to generate suction force required to suck up rubbish on the floor to be cleaned. The fan motor unit 40 may be configured to bring in outside air through the suction head 10 and discharge the air through exhaust holes 23 and 24 of the housing 20. The fan motor unit 40 may be arranged within the housing 20 in a state of being equipped in the main body 30.

Referring to FIGS. 2 to 4, when the main body 30 is coupled with the housing 20, a first dust collection chamber 81 and a second dust collection chamber 82 may be formed in the vacuum cleaner 1. Specifically, when the main body 30 is in the first position in relation to the housing 20, the first dust collection chamber 81 and the second dust collection chamber 82 may be formed in the vacuum cleaner 1.

An outer case 83 that forms the dust collection chambers 81 and 82 and an inner case 84 arranged inside the outer case 83 may be provided in the housing 20. The outer case 83 may be arranged between the housing 20 and the inner case 84.

The outer case 83 may form a case flow path 85 together with the inner case 84. The case flow path 85 may lead air that has passed the first dust collection chamber 81 to the second dust collection chamber 83.

The inner case 84 may be arranged inside the outer case 83. The first dust collection chamber 81 may be formed inside the inner case 84. A filtering device 86 may be provided in the inner case 84. The first dust collection chamber 81 may collect rubbish filtered off when the air brought in through the suction head 10 passes the filtering device 86.

The filtering device 86 may initially filter the rubbish off from the air brought in through the suction head 10. The filtering device 86 may extend along a portion of the inner surface of the inner case 84. The rubbish filtered off by the filtering device 86 may be collected in the first dust collection chamber 81. The filtering device 86 may be formed of a mesh member.

The inner case 84 may include a case opening 87 through which the air led through the case flow path 85 is brought into a rubbish separation device 51.

The air brought into the rubbish separation device 51 through the case opening 87 may be secondly filtered in the rubbish separation device 51. The rubbish filtered off by the rubbish separation device 51 may be collected in the second dust collection chamber 82. The air filtered in the rubbish separation device 51 may be moved to the motor filter 46.

The main body 30 may include the opening or closing device 60 formed to open or close the first dust collection chamber 81. The opening or closing device 60 may be arranged at an end of the main body 30 facing the suction head 10. The opening or closing device 60 may be formed to work with a first rubbish removal member 70 and a second rubbish removal member 75.

As the opening or closing device 60 works with the first rubbish removal member 70 and/or the second rubbish removal member 75, unintentional opening of the first dust collection chamber 81 may be prevented and the dust collection chambers 81 and 82 may be opened only to discharge the rubbish. The opening or closing device 60 may include an opening or closing member 61, an opening or closing cover 62, and an opening or closing sealing member 63.

The opening or closing device 60 may be arranged to be moved away from the housing 20 to open the first dust collection chamber 81 when the first rubbish removal member 70 slides and is drawn out from the first dust collection chamber 81. The opening or closing device 60 may be arranged to be moved nearer to the housing 20 to close the first dust collection chamber 81 when the first rubbish removal member 70 slides and is drawn into the first dust collection chamber 81.

The opening or closing member 61 may open or close the first dust collection chamber 81 as the main body 30 slides against the housing 20. The opening or closing member 61 may include a chamber inlet 61*a* formed for the air brought in from the suction head 10 to flow into the first dust collection chamber 81. The chamber inlet 61*a* may be opened or closed by the opening or closing cover 62.

The opening or closing cover 62 may be formed to include an elastic material. The opening or closing cover 62 may open the chamber inlet 61*a* in a direction in which air flows into the first dust collection chamber 81. On the contrary, the opening or closing cover 62 may be arranged not to open the chamber inlet 61*a* in an opposite direction from the direction in which air flows into the first dust collection chamber 81. In other words, the opening or closing cover 62 may open the chamber inlet 61*a* when the vacuum cleaner 1 sucks up rubbish on the floor to be cleaned, but may not open the chamber inlet 61*a* in a direction of discharging dust from the first dust collection chamber 81. Hence, scattering of the rubbish may be prevented when the housing 20 is separated from the suction head 10.

The opening or closing cover 62 may include a cover hinge part 62*a*. When the fan motor unit 40 generates suction force, the opening or closing cover 62 may be elastically deformed to open the chamber inlet 61*a* while the cover hinge part 62*a* is fixed. When the fan motor unit 40 generates no suction force, the opening or closing cover 62 may return to a position to close the chamber inlet 61*a* by elastic force.

The opening or closing sealing member 63 may be provided to seal between the inner case 84 and the opening or closing member 61. The opening or closing member 63 may be arranged along edges of the opening or closing member 61. The opening or closing member 63 may be formed to include an elastic material. The opening or closing member 63 may be formed to include a more flexible material than the opening or closing member 61. The opening or closing member 63 may closely contact the inner surface of the inner case 84 to seal the first dust collection chamber 81. Accordingly, the vacuum cleaner 1 in the embodiment of the disclosure may prevent the rubbish from coming out of the first dust collection chamber 81.

The main body 30 may include the first rubbish removal member 70 arranged to discharge the rubbish from the first dust collection chamber 81. The first rubbish removal member 70 may be arranged to slide on the first dust collection chamber 81. The first rubbish removal member 70 may include a first installation portion 71 and a first rubbish remover 72 installed in the first installation portion 71.

The first rubbish remover 72 may be formed to include an elastic material. The first rubbish remover 72 may be formed to closely contact an inner wall of the filtering device 86. The first rubbish remover 72 may be arranged to closely contact a surface of the filtering device 86 through which rubbish is filtered. When the main body 30 slides against the housing 20, the first rubbish remover 72 may slide in a state of closely contacting the inner surface of the filtering device 86. The first rubbish remover 72 may remove rubbish such as hair tangled with the inner surface of the filtering device 86 by scratching the inner surface of the filtering device 86 when the main body 30 is forced to slide into the housing 20.

The first rubbish removal member 70 may move from a first position between the filtering device 86 and the rubbish separation device 51 to a second position protruding out of the housing 20. Hence, the first rubbish removal member 70 may discharge the rubbish present in the first dust collection chamber 81 to the outside. Furthermore, as the first rubbish removal member 70 protrudes out of the housing 20, dust collected in the second dust collection chamber 82 may also be discharged to the outside.

The main body 30 may include a first connector 69 that connects the first rubbish removal member 70 to the opening or closing device 60. The first connector 69 may be arranged in the first dust collection chamber 81. The first rubbish removal member 70 and the opening or closing device 60 may be engaged by the first connector 69.

Referring to FIG. 6, a discharge opening 68 may be formed between a plurality of first connectors 69. The discharge opening 68 may be formed between the first rubbish removal member 70 and the opening or closing device 60. When the opening or closing device 60 opens the first dust collection chamber 81 and the first rubbish removal member 70 discharges rubbish from the first dust collection chamber 81, the rubbish may be discharged to the outside through the discharge opening 68.

The main body 30 may include the rubbish separation device 51. The rubbish separation device 51 may include a cyclone. The rubbish separation device 51 may centrifugally separate rubbish that has not been filtered in the first dust collection chamber 81 from the air. As the rubbish separation device 51 separates the rubbish from the air that has passed the filtering device 86 in a different method from the filtering device 86, the vacuum cleaner 1 according to the embodiment of the disclosure may have increased cleaning efficiency.

The main body 30 may include the second rubbish removal member 75 arranged to discharge the rubbish from the second dust collection chamber 82. The second rubbish removal member 75 may be arranged to slide on the second dust collection chamber 82 and the first dust collection chamber 81. The second dust collection chamber 82 may be formed between the first rubbish removal member 70 and the second rubbish removal member 75. The second rubbish removal member 75 may include a second installation portion 76 and a second rubbish remover 77 installed in the second installation portion 76.

The second rubbish remover 77 may be formed to include an elastic material. The second rubbish remover 77 may slide in a state of closely contacting the inner surface of the inner case 84 to discharge the rubbish from the second dust collection chamber 82 when the main body 30 slides against the housing 20. The second rubbish remover 77 may slide in a state of closely contacting the inner surface of the inner case 82 to empty out all the rubbish from the second dust collection chamber 84 when the main body 30 slides against the housing 20.

The main body 30 may include a second connector 79 that connects the first rubbish removal member 70 to the second rubbish removal member 75. The second connector 79 may be arranged in the second dust collection chamber 82. The second rubbish removal member 75 and the first rubbish removal member 70 may be engaged by the second connector 79.

A motor filter 46 may be provided in the main body 30. The motor filter 46 may be arranged to filter off the rubbish in the air again before the air flows into the fan motor unit 40. The motor filter 46 may be placed in front of the fan motor unit 40 in a direction of discharging the air that has passed the rubbish separation device 51. The motor filter 46 may be arranged between the fan motor unit 40 and the rubbish separation device 51. The motor filter 46 may filter off the rubbish from the air that has passed the rubbish separation device 51. The motor filter 46 may be formed of a mesh member.

The motor filter 46 may be arranged within the housing 20 in a state of being equipped in the filter case 47 of the main body 30. In the embodiment of the disclosure, the vacuum cleaner 1 may prevent the fan motor unit 40 from being damaged by the motor filter 46 due to the rubbish, and may release relatively clean air.

The fan motor unit 40 may be arranged to generate suction force for the first dust collection chamber 81 and the second dust collection chamber 82. The air that has passed the motor filter 46 may pass through the fan motor unit 40 and may then be discharged from the housing 20.

In an embodiment of the disclosure, with the fan motor unit 40, which weighs relatively heavy as compared with the battery 33, arranged farther down than the battery 33, the vacuum cleaner 1 may have the lowered center of gravity. Accordingly, with the lowered center of gravity, the vacuum cleaner 1 in the embodiment of the disclosure may increase convenience of use.

In an embodiment of the disclosure, the vacuum cleaner 1 may be provided so that a portion of the main body 30 in which the fan motor unit 40 is arranged is partitioned off from the battery installation portion 32. That is, the air moved by the fan motor unit 40 is not moved to the battery installation portion 32 and the handle 90, but discharged right through a motor exhaust hole 41 and the exhaust holes 23 and 24 of the housing 20. Accordingly, the vacuum cleaner 1 in the embodiment of the disclosure may minimize the discharged air moving toward the user.

A controller 36 may be arranged between the fan motor unit 40 and the battery installation portion 32. The controller 36 may be provided as a printed board assembly (PBA). The controller 36 may be provided to control operations of the vacuum cleaner 1.

With the aforementioned structure, to perform cleaning, the vacuum cleaner 1 in the embodiment of the disclosure may initially filter the air containing rubbish brought in from the suction head 10 in the filtering device 86 of the first dust collection chamber 81. After this, the air moved to the rubbish separation device 51 through the case flow path 85 may be filtered secondly. The air filtered in the rubbish separation device 51 may be collected in the second dust collection chamber 82. The air that has passed the rubbish separation device 51 may be filtered for the third time while passing the motor filter 46, and may then pass through the fan motor unit 40. The air that has passed through the fan motor unit 40 may be discharged through the motor exhaust hole 41 and the exhaust holes 23 and 24 of the housing 20.

Referring to FIG. 6, to empty out the rubbish collected in the dust collection chambers 81 and 82 after finishing the cleaning work, the user may make the main body 30 slide against the housing 20. In this case, the user may manipulate the button device 26 to move the main body 30.

When the main body 30 slides in the housing 20, the opening or closing device 60 arranged at an end of the main body 30 opens the first dust collection chamber 81, the first rubbish removal member 70 slides on a surface of the filtering device 86 where the rubbish is present, and the second rubbish removal member 75 slides on the inner surface of the second dust collection chamber 82 and on the surface of the filtering device 86 where the rubbish is present. The first rubbish removal member 70 may separate the rubbish present in the filtering device 86 to be discharged out of the first dust collection chamber 81. The second rubbish removal member 75 may discharge the rubbish out of the second dust collection chamber 82 and simultaneously, secondly separate the rubbish present in the filtering device 86 and discharge the rubbish out of the first dust collection chamber 81.

For this, the first rubbish removal member 70 and the second rubbish removal member 75 may be moved to a position that protrudes out of the housing 20. Alternatively, the main body 30 may be moved so that only the opening or closing device 60 is exposed to the outside of the housing 20 and the first rubbish removal member 70 and the second rubbish removal member 75 are not exposed to the outside of the housing 20. Furthermore, the main body 30 may be moved so that only the opening or closing device 60 and the first rubbish removal member 70 are exposed to the outside of the housing 20 and the second rubbish removal member 75 are not exposed to the outside of the housing 20.

When discharging of the dust out of the dust collection chambers 81 and 82 is done, the user may move the handle 90 of the main body 30 to be away from the housing 20, and accordingly, the opening or closing device 60 is moved to a position to close the first dust collection chamber 81. Furthermore, the button device 26 may fix the position of the main body 30 in relation to the housing 20.

With this structure, the vacuum cleaner 1 according to the embodiment of the disclosure may easily empty out the rubbish from the dust collection chambers 81 and 82 with a relatively simple operation. Moreover, as the opening or closing device 60 is arranged to open or close the dust collection chambers 81 and 82 only to discharge the rubbish in the dust collection chambers 81 and 82, scattering of rubbish may be prevented even when the housing 20 is detached from the suction head 10.

Figure 7:
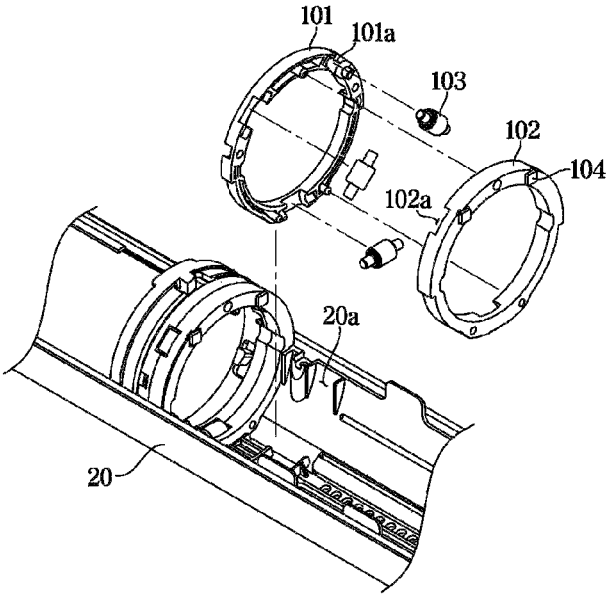
FIG. 7 is an exploded view of a guide device shown in FIG. 2, according to an embodiment of the disclosure.
Figure 8:
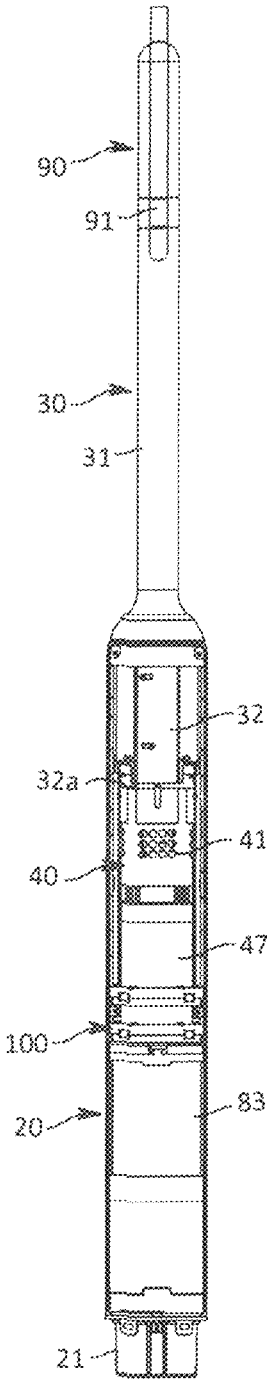
FIG. 8 illustrates the interior of a housing when a body shown in FIG. 2 is in a first position in relation to the housing, according to an embodiment of the disclosure.
Figure 9:
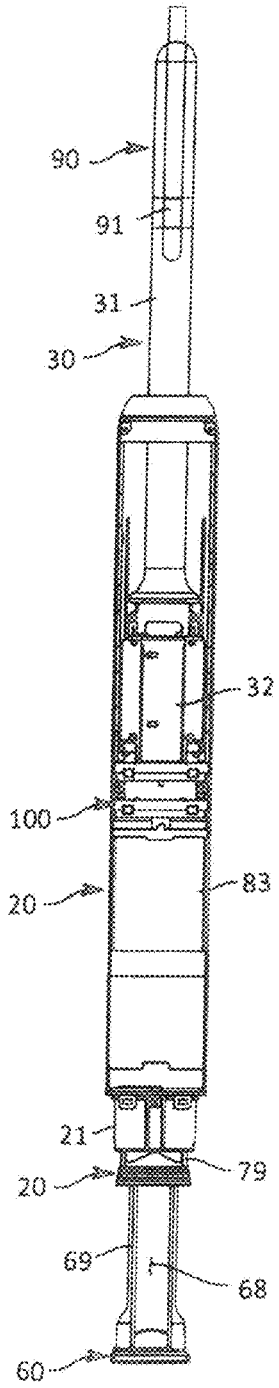
FIG. 9 illustrates the interior of the housing when the body shown in FIG. 2 is in a second position in relation to the housing, according to an embodiment of the disclosure.
Figure 10:
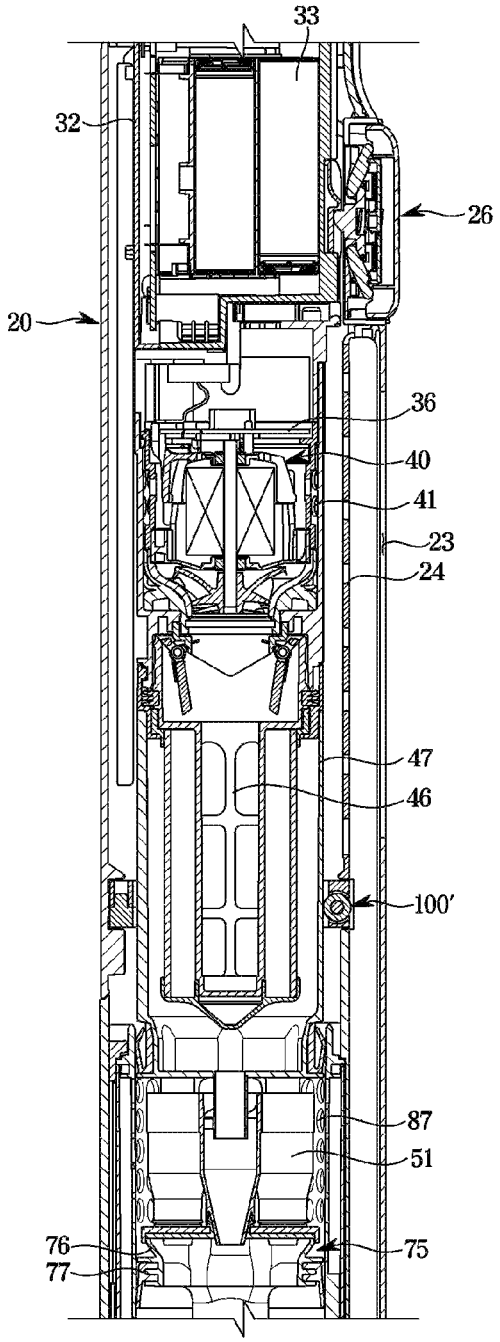
FIG. 10 illustrates a modified embodiment of the vacuum cleaner shown in FIG. 5, according to an embodiment of the disclosure.

FIG. 7 is an exploded view of a guide device shown in FIG. 2. FIG. 8 illustrates the interior of a housing when a body shown in FIG. 2 is in a first position in relation to the housing. FIG. 9 illustrates the interior of the housing when the body shown in FIG. 2 is in a second position in relation to the housing. FIG. 10 illustrates a modified embodiment of the vacuum cleaner shown in FIG. 5.

Referring to FIGS. 7 to 9, the guide device 100 may be fixed to the housing 20. The housing 20 may include a guide installation portion 20*a* where the guide device 100 is installed. The guide device 100 may be provided in the plural and arranged at certain intervals in the moving direction of the main body 30 to stably support the main body 30. Although two guide devices 100 are shown in FIGS. 7 to 9 as being arranged, the number of the guide devices 100 is not limited thereto and there may be one or three or more guide devices 100.

Specifically, referring to FIG. 10, the vacuum cleaner 1 may include one guide device 100'. Accordingly, the vacuum cleaner 1 may save the cost of production.

The guide device 100 may include a first body 101, a second body 102, and a roller 103. The first body 101 and the second body 102 may be referred to as a body 101 and 102.

The first body 101 may include a first roller installation portion 101*a* at which the roller 103 is rotationally mounted. The second body 102 may also include a second roller installation portion 102*a* at which the roller 103 is rotationally mounted. The second roller installation portion 102*a* of the second body 102 may be arranged to match the first roller installation portion 101*a* of the first body 101.

The rollers 103 may be rotationally mounted at the first body 101 and the second body 102. The rollers 103 may be provided to support the outer surface of the main body 30. The rollers 103 may protrude from a surface of the body 101 and 102 facing the main body 30 toward the main body 30. The rollers 103 may have a rotation axis perpendicular to the moving direction of the main body 30 against the housing 20. Accordingly, the rollers 103 may roll on the outer surface of the main body 30.

The rollers 103 may be arranged in the plural, which are arranged equidistantly along the outer circumference of the main body 30. Although three rollers 103 are shown in FIG. 7 as being arranged, the number of the rollers 103 is not limited thereto, and any number of rollers may be provided at various locations as long as the rollers may guide the movement of the main body 30 against the housing 20 and arrange the position of the main body 30 in relation to the housing 20.

Specifically, an inner space formed by the plurality of rollers 103 may be provided to match the outer surface of the main body 30 supported by the rollers 103. Hence, when the main body 30 is coupled to the housing 20 in a wrong position, the rollers 103 may guide the main body 30 so that the main body 30 is coupled with the housing 20 in a right position. The main body 30 may be provided in a substantially cylindrical form, and distances from the center axis based on a moving direction of the main body 30 to the plurality of rollers 103 are the same.

A stopper 104 may be provided in the second body 102. The stopper 104 may be arranged on a surface of the second body 102 facing the battery installation portion 32.

When the main body 30 is in the second position in relation to the housing 20, the stopper 104 may support the main body 30 for the opening or closing device 60 not to be moved away from the housing 20. In other words, when the main body 30 is in the second position, the stopper 104 may limit the movement in an opposite direction from a direction toward the first position. Specifically, the stopper 104 may support the battery installation portion 32 of the main body 30. The stopper 104 may support a stick part 32*a* protruding from the battery installation portion 32.

The stopper 104 may be formed of a buffer material to relieve impact when the main body 30 collides with the guide device 100 while moving from the first position to the second position in relation to the housing 20, With this structure, the vacuum cleaner 1 according to the embodiment of the disclosure may easily move the main body 30 against the housing 20 to empty out rubbish from the dust collection chambers 81 and 82. In other words, the guide device 100 reduces frictional force when the main body 30 is moved against the housing 20, allowing the user to manipulate the vacuum cleaner 1 with relatively small force.

Furthermore, a movement distance of the main body 30 in relation to the housing 20 to open the dust collection chambers 81 and 82 may be limited with a relatively simple structure, and impact from collision between the main body 30 and the housing 20 may be relieved.

Several embodiments of the disclosure have been described above, but a person of ordinary skill in the art will understand and appreciate that various modifications can be made without departing from the scope of the disclosure. Thus, it will be apparent to those or ordinary skill in the art that the true scope of technical protection is only defined by the following claims.

What is claimed is:

1. A vacuum cleaner comprising:

a housing having a dust collection chamber inside the housing;

a main body that is movable against the housing between a first position and a second position;

a guide device between the housing and the main body, and including a roller to guide movement of the main body against the housing;

a rubbish removal member in the dust collection chamber; and an opening or closing device to open or close the dust collection chamber, wherein the main body, the guide device, the rubbish removal member, and the opening or closing device are configured so that, when the main body is moved against the housing from the first position to the second position, the opening or closing device opens the dust collection chamber, and the rubbish removal member moves toward an open end of the dust collecting chamber to allow rubbish removed by the rubbish removal member to be discharged out of the dust collection chamber, and when the main body is moved against the housing from the second position to the first position, the rubbish removal member moves away from the open end of the dust collection chamber toward an inside of the dust collection chamber, and the opening or closing device closes the dust collection chamber.

2. The vacuum cleaner of claim 1, wherein the roller protrudes from a surface of the guide device facing the main body toward the main body.

3. The vacuum cleaner of claim 2, wherein the roller has a rotation axis perpendicular to a moving direction of the main body.

4. The vacuum cleaner of claim 2, wherein the roller is arranged to roll on an outer surface of the main body.

5. The vacuum cleaner of claim 2, wherein the guide device includes a body rotationally supporting the roller.

6. The vacuum cleaner of claim 1, wherein the guide device includes a plurality of rollers equidistantly spaced apart from each other along an outer circumference of the main body.

7. The vacuum cleaner of claim 1, wherein the guide device further includes a stopper to limit movement of the main body to an opposite direction from a direction toward the first position in response to the main body being in the second position.

8. The vacuum cleaner of claim 7, wherein the stopper includes a buffer material.

9. The vacuum cleaner of claim 7, wherein the main body includes a battery installation portion in which a battery is mounted, and the stopper is arranged to support the battery installation portion in response to the main body being in the second position.

10. The vacuum cleaner of claim 9, wherein the battery installation portion is in the housing.

11. The vacuum cleaner of claim 1, wherein the guide device is provided in the singular, or in the plural at certain intervals in a moving direction of the main body.

12. The vacuum cleaner of claim 1, wherein the housing includes a guide installation portion on an inner surface of the housing to which the guide device is installed so as to be fixed to the housing.

13. The vacuum cleaner of claim 1, wherein the dust collection chamber is a first dust collection chamber, the vacuum cleaner includes a rubbish separation device to remove rubbish from air having passed the first dust collection chamber, and the housing has a second dust collection chamber inside the housing for collecting rubbish separated from the rubbish separation device.

14. The vacuum cleaner of claim 13, wherein the rubbish removal member is a first rubbish removal member, and the vacuum cleaner includes a second rubbish removal member arranged to slide on the second dust collection chamber and the first dust collection chamber to discharge rubbish from the second dust collection chamber in response to the main body moving from the first position to the second position.

15. A vacuum cleaner comprising:

a housing having a dust collection chamber inside the housing;

a main body that is movable against the housing between a first position and a second position;

a guide device between the housing and the main body, fixed to the housing, and including a roller protruding toward the main body so as to roll on an outer surface of the main body to guide movement of the main body against the housing;

a rubbish removal member in the dust collection chamber; and an opening or closing device to open or close the dust collection chamber, wherein the main body, the guide device, the rubbish removal member, and the opening or closing device are configured so that, when the main body is moved against the housing from the first position to the second position, the opening or closing device opens the dust collection chamber, and the rubbish removal member moves toward an open end of the dust collecting chamber to allow rubbish removed by the rubbish removal member to be discharged out of the dust collection chamber, and when the main body is moved against the housing from the second position to the first position, the rubbish removal member moves away from the open end of the dust collection chamber toward an inside of the dust collection chamber, and the opening or closing device closes the dust collection chamber.

* * * * *